US011140964B2

(12) United States Patent
Shen

(10) Patent No.: US 11,140,964 B2
(45) Date of Patent: Oct. 12, 2021

(54) BOTTLE TYPE LIP GLOSS TUBE

(71) Applicant: APR Beauty Group Inc., Toronto (CA)

(72) Inventor: Jun Shen, New Westminster (CA)

( * ) Notice: Subject to any disclaimer, the term of this patent is extended or adjusted under 35 U.S.C. 154(b) by 300 days.

(21) Appl. No.: 16/502,400

(22) Filed: Jul. 3, 2019

(65) Prior Publication Data

US 2020/0397118 A1 Dec. 24, 2020

(30) Foreign Application Priority Data

Jun. 24, 2019 (CN) ..... 201920953334.9

(51) Int. Cl.
*A45D 34/04* (2006.01)
*A45D 40/26* (2006.01)

(52) U.S. Cl.
CPC ..... *A45D 34/045* (2013.01); *A45D 34/043* (2013.01); *A45D 34/046* (2013.01); *A45D 40/264* (2013.01); *A45D 40/265* (2013.01); *A45D 40/267* (2013.01)

(58) Field of Classification Search
CPC .. A45D 34/042; A45D 34/043; A45D 34/045; A45D 34/046; A45D 40/262; A45D 40/264; A45D 40/265; A45D 40/267
USPC ..... 401/121, 122, 126, 127
See application file for complete search history.

(56) References Cited

U.S. PATENT DOCUMENTS

| | | | | |
|---|---|---|---|---|
| 7,118,298 | B2 * | 10/2006 | Tsutsumi | A45D 34/045 401/129 |
| 8,142,093 | B2 * | 3/2012 | Vanoncini | A45D 34/046 401/122 |
| 9,375,072 | B2 * | 6/2016 | Drugeon | A45D 40/26 |
| 10,045,600 | B2 * | 8/2018 | Apodaca | A45D 34/045 |
| 10,349,723 | B2 | 7/2019 | Kim | |
| 2016/0068317 | A1 | 3/2016 | Petit | |
| 2020/0128940 | A1 | 4/2020 | Lefevre et al. | |
| 2020/0205544 | A1 | 7/2020 | Kim | |

* cited by examiner

*Primary Examiner* — David J Walczak

(57) ABSTRACT

A button type lip gloss tube comprising a liquid storage tube and a lip gloss brush mounted on the liquid storage tube. The lip gloss brush comprises a cap, a rod core movably mounted in the cap, a spring pressed between the cap and the rod core, and a button ring mounted in the cap. The button ring comprises a button and an elastic ring. The elastic ring confines the liquid storage tube, which is inserted into the cap, between the rod core and the elastic ring. When the button is pressed, the elastic ring is deformed and the liquid storage tube is disengaged from the cap by an elastic force of the spring. The button type lip gloss tube is convenient to install, highly automatic in production and assembly, and is convenient for a user to use since the lip gloss tube is opened by pressing the button.

9 Claims, 7 Drawing Sheets

BOTTLE TYPE LIP GLOSS TUBE

TECHNICAL FIELD

The present utility model relates to the technical field of cosmetics, and in particular to a button type lip gloss tube.

BACKGROUND ART

In the field of cosmetics, lip gloss is a common cosmetic, and is generally a viscous liquid or thin paste containing various types of highly moisturizing oils and glittering factors. After colouring, the lips are moist and third-dimensional, especially outstanding in the pursuit of a special makeup effect, but the makeup is likely to drop, so the lip gloss needs to be carried about when in use.

The conventional lip gloss includes three main parts, i.e. a lip gloss bottle, a lip gloss brush, and a cap for covering the lip gloss bottle. The lip gloss bottle and the cap are integrally connected by means of spiral limiting. However, the above connection method has the following disadvantages: 1. the lip gloss bottle and the cap are inconvenient to install, and have a low degree of automation of production and assembly, resulting in large time consumption, great labor waste and a high installation cost; and 2. the operation is cumbersome when a user opens or locks the cap, so that the makeup efficiency of the user is low and the user experience is poor.

SUMMARY OF THE UTILITY MODEL

The present utility model is directed to provide a button type lip gloss tube, which is convenient to install, highly automatic in production and assembly, and is convenient for a user to use since the lip gloss tube is opened by a button and locked by insertion.

The above technical object of the present utility model is achieved by the following technical solution: a button type lip gloss tube, comprising a liquid storage tube and a lip gloss brush mounted on the liquid storage tube, wherein the lip gloss brush comprises a cap, a rod core movably mounted in the cap, and a spring pressed between the cap and the rod core; a button ring is mounted in the cap in a limited manner, the button ring comprises a button and an elastic ring, and the elastic ring confines the liquid storage tube, which is inserted into the cap, between the rod core and the elastic ring; and when the button is pressed, the elastic ring is deformed under pressure, and the liquid storage tube is disengaged from the cap by the elastic force of the spring.

Further, a flange radially protrudes from an upper end of the liquid storage tube, and when the liquid storage tube is inserted into the cap, the flange is confined between the rod core and the elastic ring.

Further, the button ring is elliptical, and an abutting end abutting against an inner wall of the cap protrudes from the side of the elastic ring relative to the button.

Further, a limiting groove is formed on the side of the elastic ring relative to the button, a lining is mounted in the cap, and a stop block in limiting engagement with the limiting groove extends vertically upward at one end of the lining.

Further, the outer circumference of the lining is provided with a clamping groove, and a snap ring engaged with the clamping groove is arranged in the radial direction of the inner wall of the cap in a protruding manner.

Further, the lining is provided with a notch for pressing the button to extend into the cap.

Further, the cap is provided with a limiting rib for limiting circumferential rotation of the elastic ring, and the limiting rib is mounted in the limiting groove of the elastic ring.

Further, a first guiding portion is arranged at an inner wall port of the lining, and the liquid storage tube is provided with a second guiding portion in guiding engagement with the first guiding portion.

Further, an inner plug is mounted at the orifice of the liquid storage tube, and a lower end of the inner plug is provided with an open boss adapted to the rod core.

Further, a concave ring is arranged on an inner wall of the liquid storage tube, a raised rib engaged with the concave ring is arranged on an outer wall of the inner plug, and an upper end of the inner plug abuts against an end edge of the liquid storage tube.

In summary, the present utility model has the following advantageous effects:

in a button type lip gloss tube, a flange radially protrudes from an upper end of a liquid storage tube, a button ring for confining the flange between a rod core and an elastic ring is arranged on a capped tube, and a spring is arranged between a cap and the rod core; when a button of the button ring is pressed, an abutting end of the elastic ring abuts against an inner wall of the cap and the elastic ring is not rotated by radial limitation of a limiting rib, the elastic ring is deformed to disengage the flange from the rod core and the elastic ring, and at this time, the liquid storage tube is quickly separated from the cap by the elastic force of the spring; when the cap is inserted into the liquid storage tube, an inner plug at the orifice of the liquid storage tube pushes the rod core up and compresses the spring such that the flange of the liquid storage tube is confined between the rod core and the elastic ring, and the liquid storage tube is locked with the lip gloss brush as a whole, thereby bringing great convenience to a user, improving the makeup efficiency of the user, and then enhancing the user experience; and on the other hand, the lip gloss tube has a pluggable structure, in which the liquid storage tube is separated from the lip gloss brush via the button, so that the button type lip gloss tube is convenient to install and highly automatic in production and assembly.

In the figures: 1. Liquid storage tube; 11. Flange; 12. Second guiding portion; 13. Concave ring; 14. Recess; 2. Lip gloss brush; 21. Cap; 211. Snap ring; 212. Limiting rib; 22. Rod core; 221. Guide cylinder; 222. Circular guide groove; 223. Sealing ring; 224. Brush head; 23. Spring; 24. Lining; 241. Stop block; 242. Clamping groove; 243. Notch; 244. First guiding portion; 3. Button ring; 31. Button; 32. Elastic ring; 321. Abutting end; 33. Limiting groove; 4. Inner plug; 41. Open boss; 42. Raised rib.

DETAILED DESCRIPTION OF EMBODIMENTS

The present utility model will be described below in conjunction with the accompanying drawings.

Figure 1:
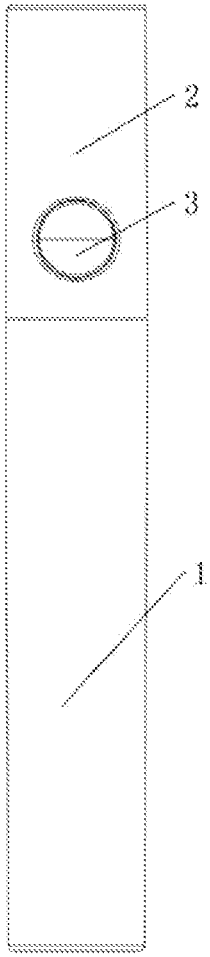
FIG. 1 is a front view of the present utility model.
Figure 2:
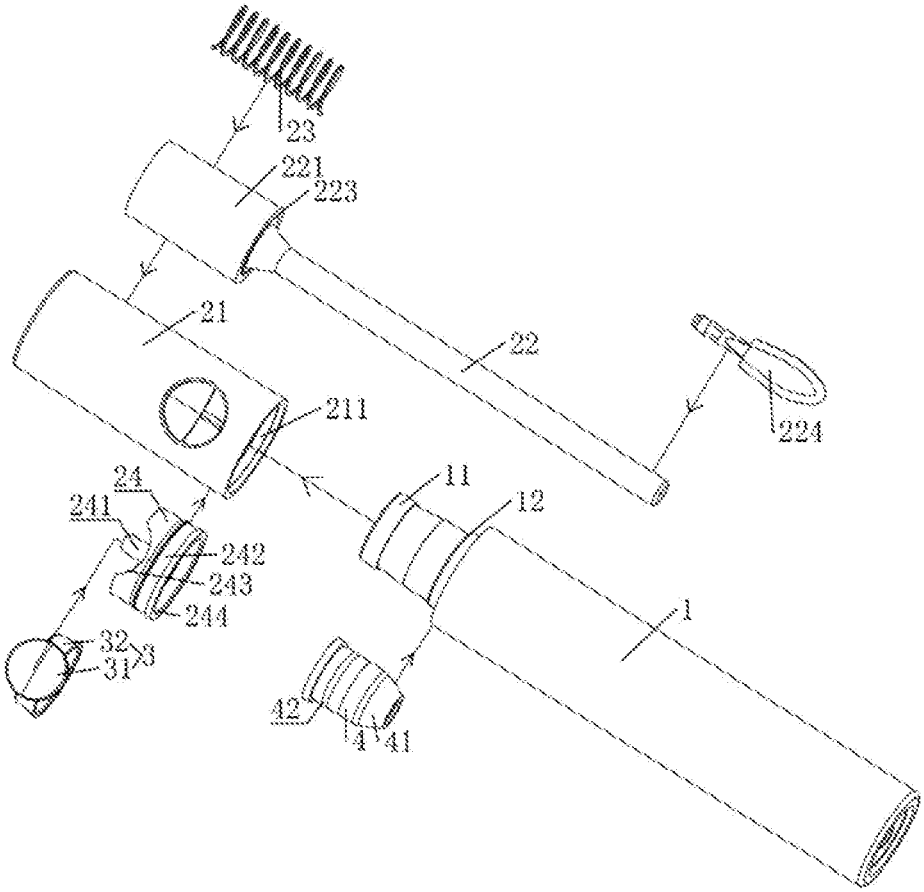
FIG. 2 is an exploded view of the present utility model.
Figure 3:
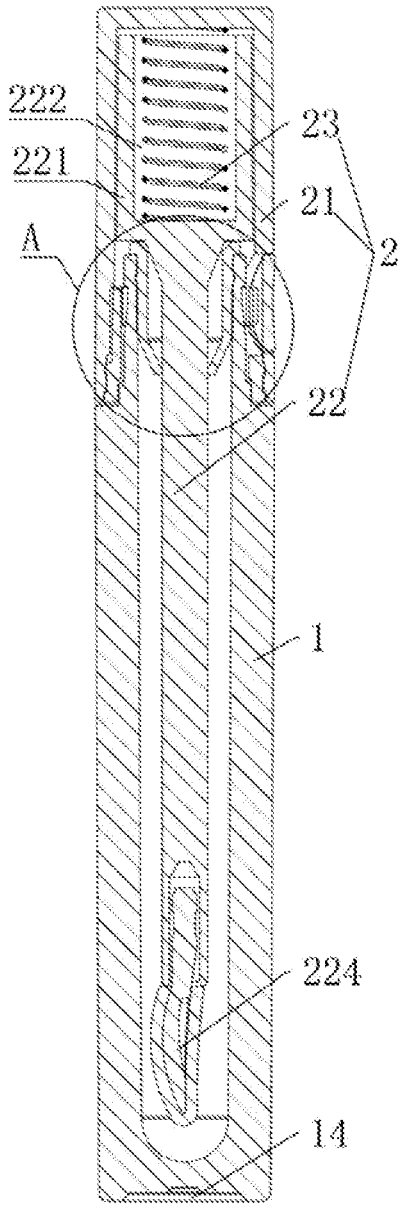
FIG. 3 is a longitudinal sectional view of the present utility model.
Figure 4:
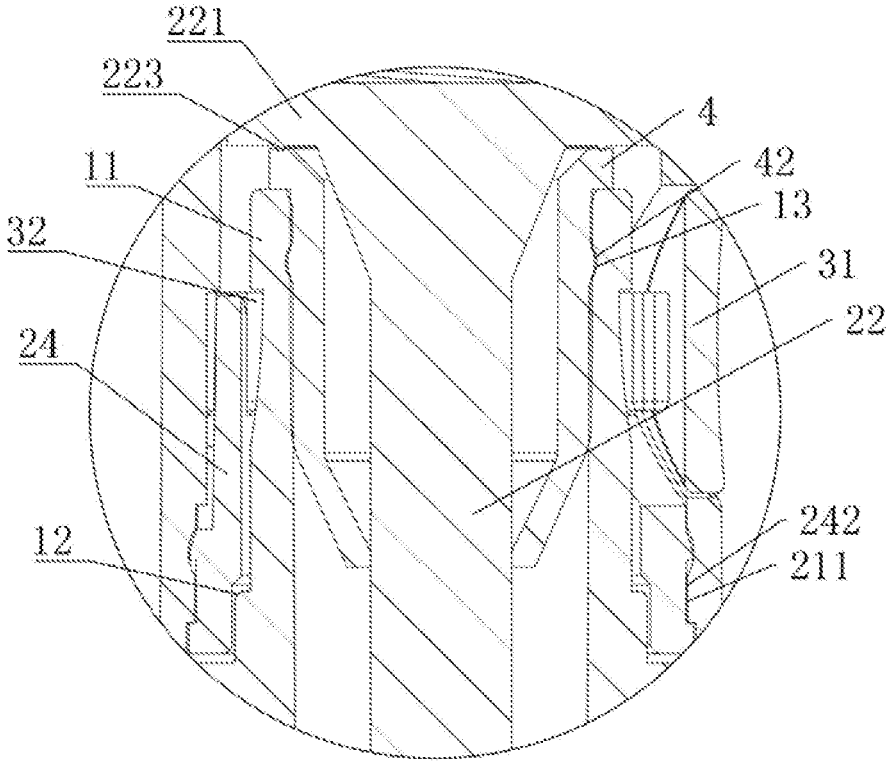
FIG. 4 is an enlarged view of a section A of the present utility model.
Figure 5:
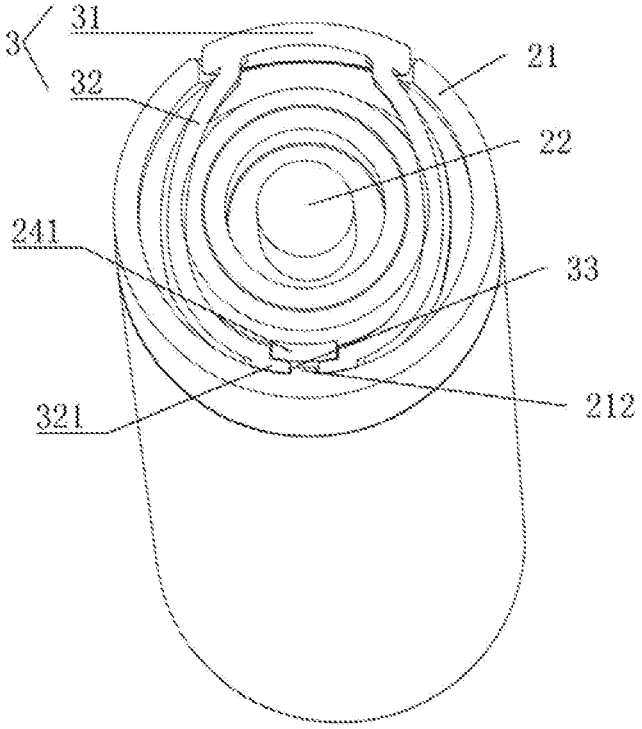
FIG. 5 is a cross-sectional view of the present utility model.
Figure 6:
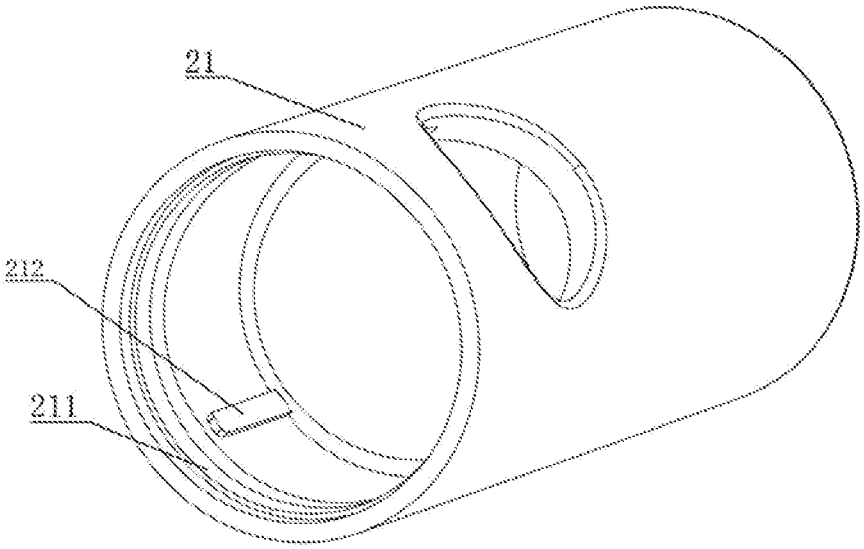
FIG. 6 is a structural diagram of a cap according to the present utility model.
Figure 7:
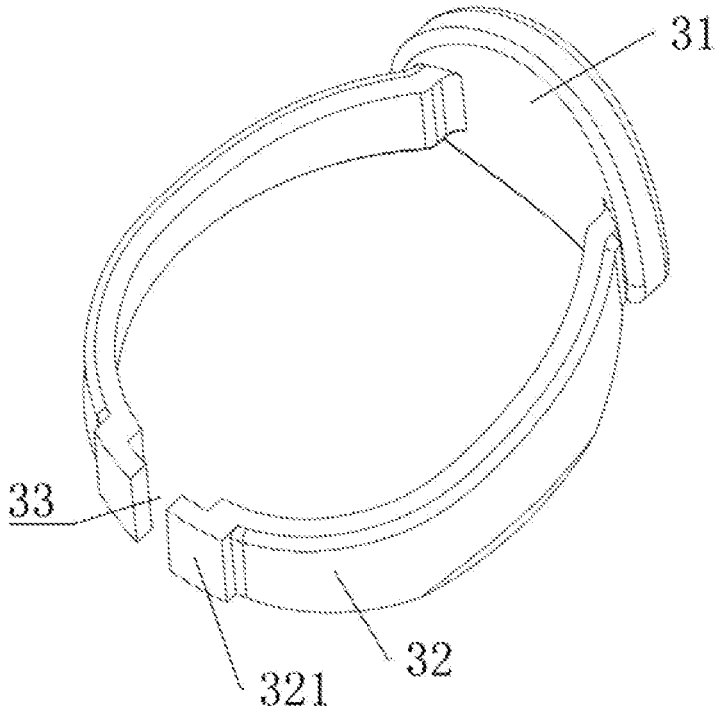
FIG. 7 is a structural diagram of a button ring according to the present utility model.

As shown in FIGS. 1-7, a button type lip gloss tube comprises a liquid storage tube 1, and a lip gloss brush 2 mounted on the liquid storage tube 1. The lip gloss brush 2 comprises a cap 21, a rod core 22, and a spring 23 pressed between the cap 21 and the rod core 22. A guide cylinder 221 is arranged at an upper end of the rod core 22, the guide cylinder 221 is provided with a circular guide groove 222 adapted to the outer diameter of the spring 23, the spring 23 is arranged in the circular guide groove 222, and the spring 23 is retractable along the axis of the circular guide groove 222. An inner cavity for providing the rod core 22 is formed at an inner end of the lip gloss brush 2, and the guide cylinder 221 of the rod core 22 is slidable up and down inside an inner cavity of the lip gloss brush 2.

A button ring 3 is mounted in the cap 21 in a limited manner, the button ring 3 comprises a button 31 and an elastic ring 32, a side wall of the cap 21 is provided with a button groove, and the elastic ring 32 confines the liquid storage tube 1, which is inserted into the cap 21, between the rod core 22 and the elastic ring 32, so that the cap 21 is locked with the liquid storage tube 1 inserted into the cap 21 as a whole. When the button 31 is pressed, the elastic ring 32 is deformed under pressure, and the liquid storage tube 1 is disengaged from the cap 21 by the elastic force of the spring 23.

A lining 24 is mounted in the cap 21, and the lining 24 is provided with a notch 243 for pressing the button 31 to extend into the cap 21. The outer circumference of the lining 24 is provided with a clamping groove 242, a snap ring 211 engaged with the clamping groove 242 is arranged in the radial direction of an inner wall of the cap 21 in a protruding manner, and the snap ring 211 is engaged with the clamping groove 242 to fix the lining 24 to an inner port of the cap 21.

The button ring 3 is elliptical, and an abutting end 321 abutting against the inner wall of the cap 21 protrudes from the side of the elastic ring 32 relative to the button 31.

A limiting groove 33 is formed on the side of the elastic ring 32 relative to the button 31, and a stop block 241 in limiting engagement with the limiting groove 33 extends vertically upward at one end of the lining 24. During installation, the abutting end 321 is confined between the inner wall of the cap 21 and the stop block 241, so that the elastic ring 32 cannot move left and right.

The cap 21 is provided with a limiting rib 212. With the arrangement of the limiting rib 212, when the button 31 is pressed and the elastic ring 32 is deformed, circumferential rotation of the limiting rib 212 is avoided.

A flange 11 radially protrudes from an upper end of the liquid storage tube 1. When the liquid storage tube 1 is inserted into the cap 21, the flange 11 is confined between the rod core 22 and the elastic ring 32.

A brush head 224 is arranged at a lower end of the rod core 22 (the installation of the brush head 224 is the prior art, and details are not described herein), and the brush head 224 is a metal brush head 224 or a cotton head.

An inner plug 4 is mounted at the orifice of the liquid storage tube 1, a concave ring 13 is arranged on an inner wall of the liquid storage tube 1, a raised rib 42 engaged with the concave ring 13 is arranged on an outer wall of the inner plug 4, an upper end of the inner plug 4 abuts against an end edge of the liquid storage tube 1, and a lower end of the inner plug 4 is provided with an open boss 41 adapted to the rod core 22 to limit excessive lip gloss liquid adhered to the brush head 224 at the lower end of the rod core 22.

A first guiding portion 244 is arranged at an inner wall port of the lining 24, and the liquid storage tube 1 is provided with a second guiding portion 12 in guiding engagement with the first guiding portion 244. The first guiding portion 244 and the second guiding portion 12 are provided to facilitate insertion of the cap 21 into the liquid storage tube 1.

A sealing ring 223 is arranged at the lower end of the guide cylinder 221 of the rod core 22, and the sealing ring 223 is pressed between the guide cylinder 221 and the inner plug 4 to seal the lip gloss liquid in the liquid storage tube 1, thus avoiding leakage of the lip gloss liquid when the lip gloss tube is tilted.

The lower end of the liquid storage tube 1 is provided with a recess 14 for vertically placing the lip gloss tube more stably and saving on the material cost.

The basic working principle of the present utility model is:

in a button type lip gloss tube, a flange 11 radially protrudes from an upper end of a liquid storage tube 1, a button ring 3 for confining the flange 11 between a guide cylinder 221 and an elastic ring 32 is arranged on a capped tube, and a spring 23 pressed between an inner end of a circular guide groove 222 and a cap 21 is arranged in the circular guide groove 222; when a button 31 of the button ring 3 is pressed, an abutting end 321 of the elastic ring 32 abuts against an inner wall of the cap 21 and the elastic ring 32 is not rotated by radial limitation of a limiting rib 212, the elastic ring 32 is deformed to disengage the flange 11 from the guide cylinder 221 and the elastic ring 32, and at this time, the liquid storage tube 1 is quickly separated from the cap 21 by the elastic force of the spring 23; when the cap 21 is inserted into the liquid storage tube 1, an inner plug 4 at the orifice of the liquid storage tube 1 pushes a rod core 22 up and compresses the spring 23 such that the flange 11 of the liquid storage tube 1 is confined between the guide cylinder 221 and the elastic ring 32, and the liquid storage tube 1 is locked with the lip gloss brush 2 as a whole, thereby bringing great convenience to a user, improving the makeup efficiency of the user, and then enhancing the user experience; and on the other hand, the lip gloss tube has a pluggable structure, in which the liquid storage tube 1 is separated from the lip gloss brush 2 via the button 31, so that the button type lip gloss tube is convenient to install and highly automatic in production and assembly.

The above descriptions are merely preferred embodiments of the present utility model, and all equivalent variations or modifications made to the structures, features and principles described in the scope of the present utility model fall into the scope of the present utility model.

The invention claimed is:

1. A button type lip gloss tube, comprising a liquid storage tube (1) and a lip gloss brush (2) mounted on the liquid storage tube (1), characterized in that: the lip gloss brush (2) comprises a cap (21), a rod core (22) movably mounted in the cap (21), and a spring (23) pressed between the cap (21) and the rod core (22); a button ring (3) is mounted in the cap (21) in a limited manner, the button ring (3) comprises a button (31) and an elastic ring (32), and the elastic ring (32) confines the liquid storage tube (1), which is inserted into the cap (21), between the rod core (22) and the elastic ring (32); a limiting groove (33) is formed on a side of the elastic ring (32) relative to the button (31); a lining (24) is mounted in the cap (21); a stop block (241) in limiting engagement with the limiting groove (33) extends vertically upward at one end of the lining (24); and when the button (31) is pressed, the elastic ring (32) is deformed under pressure, and the liquid storage tube (1) is disengaged from the cap (21) by an elastic force of the spring (23).

2. The button type lip gloss tube according to claim 1, characterized in that: a flange (11) radially protrudes from an upper end of the liquid storage tube (1), and when the liquid storage tube (1) is inserted into the cap (21), the flange (11) is confined between the rod core (22) and the elastic ring (32).

3. The button type lip gloss tube according to claim 1, characterized in that: the button ring (3) is elliptical, and an abutting end (321) abutting against an inner wall of the cap (21) protrudes from the side of the elastic ring (32) relative to the button (31).

4. The button type lip gloss tube according to claim 1, characterized in that: an outer circumference of the lining (24) is provided with a clamping groove (242), and a snap ring (211) engaged with the clamping groove (242) is arranged in the radial direction of an inner wall of the cap (21) in a protruding manner.

5. The button type lip gloss tube according to claim 1, characterized in that: the lining (24) is provided with a notch (243) for pressing the button (31) to extend into the cap (21).

6. The button type lip gloss tube according to claim 1, characterized in that: the cap (21) is provided with a limiting rib (212) for limiting circumferential rotation of the elastic ring (32), and the limiting rib (212) is mounted in the limiting groove (33) of the elastic ring (32).

7. The button type lip gloss tube according to claim 1, characterized in that: a first guiding portion (244) is arranged at an inner wall port of the lining (24), and the liquid storage tube (1) is provided with a second guiding portion (12) in guiding engagement with the first guiding portion (244).

8. The button type lip gloss tube according to claim 1, characterized in that: an inner plug (4) is mounted at an orifice of the liquid storage tube (1), and a lower end of the inner plug (4) is provided with an open boss (41) adapted to the rod core (22).

9. The button type lip gloss tube according to claim 8, characterized in that: a concave ring (13) is arranged on an inner wall of the liquid storage tube (1), a raised rib (42) engaged with the concave ring (13) is arranged on an outer wall of the inner plug (4), and an upper end of the inner plug (4) abuts against an upper end edge of the liquid storage tube (1).

* * * * *